US007062930B2

(12) United States Patent
Rayburn

(10) Patent No.: US 7,062,930 B2
(45) Date of Patent: Jun. 20, 2006

(54) SYSTEM AND METHOD FOR USING HOT GAS RE-HEAT FOR HUMIDITY CONTROL

(75) Inventor: Ronald Richard Rayburn, Norman, OK (US)

(73) Assignee: York International Corporation, York, PA (US)

( * ) Notice: Subject to any disclaimer, the term of this patent is extended or adjusted under 35 U.S.C. 154(b) by 326 days.

(21) Appl. No.: 10/694,331

(22) Filed: Oct. 27, 2003

(65) Prior Publication Data

US 2004/0089002 A1 May 13, 2004

Related U.S. Application Data

(60) Provisional application No. 60/424,929, filed on Nov. 8, 2002.

(51) Int. Cl.
*F25B 29/00* (2006.01)

(52) U.S. Cl. ..... 62/173; 62/176.1; 62/175; 62/196.4

(58) Field of Classification Search ..... 62/173, 62/175, 176.1, 196.4; 236/44 C
See application file for complete search history.

(56) References Cited

U.S. PATENT DOCUMENTS

| | | | |
|---|---|---|---|
| 2,961,844 | A | 11/1960 | McGrath |
| 3,105,366 | A | 10/1963 | Atchison |
| 3,139,735 | A | 7/1964 | Malkoff et al. |
| 3,203,196 | A | 8/1965 | Malkoff |
| 3,316,730 | A | 5/1967 | Laurer |
| 3,402,564 | A | 9/1968 | Nussbaum |
| 3,779,031 | A | 12/1973 | Aklyama et al. |
| 3,786,859 | A | 1/1974 | Day |
| 4,018,584 | A | 4/1977 | Mullen |
| 4,173,125 | A | 11/1979 | Bradshaw |
| 4,173,924 | A | 11/1979 | Bradshaw |
| 4,182,133 | A | 1/1980 | Haas et al. |
| 4,189,929 | A | 2/1980 | Russell |

(Continued)

FOREIGN PATENT DOCUMENTS

| | | |
|---|---|---|
| JP | 58-117935 | 7/1983 |

(Continued)

OTHER PUBLICATIONS

Department of the Air Force Letter, Tyndall Air Force Base, Jul. 13, 1993.

(Continued)

*Primary Examiner*—Cheryl Tyler
*Assistant Examiner*—B. Clayton McCraw
(74) *Attorney, Agent, or Firm*—McNees Wallace & Nurick LLC

(57) ABSTRACT

A humidity control method is provided for a multi-stage cooling system having two or more refrigerant circuits. A hot gas re-heat circuit having a hot gas re-heat coil is connected to one of the refrigerant circuits and is placed in fluid communication with the output airflow from the evaporator of that refrigerant circuit to provide additional dehumidification to the air. Humidity control is only performed during cooling operations and ventilation operations. During a first stage cooling operation using only one refrigerant circuit and having a low cooling demand, the request for humidity control activates the hot gas re-heat circuit for dehumidification and activates a second refrigerant circuit to provide cooling capacity. During a second stage cooling operation using two or more refrigerant circuits and having a high cooling demand, the request for humidity control is suspended and is initiated only upon the completion of the second stage cooling demand.

17 Claims, 2 Drawing Sheets

U.S. PATENT DOCUMENTS 4,270,362 A 6/1981 Lancia et al.
4,271,678 A 6/1981 Liebert
4,271,898 A 6/1981 Freeman
4,290,480 A 9/1981 Sulkowski
4,350,023 A 9/1982 Kuwabara et al.
4,367,631 A 1/1983 Johnson et al.
4,367,787 A 1/1983 Bradshaw
4,398,452 A 8/1983 Bradshaw
4,432,147 A 2/1984 Chen et al.
4,442,049 A 4/1984 Bloomer
4,494,596 A 1/1985 Bradshaw
4,527,247 A 7/1985 Kaiser et al.
4,813,474 A 3/1989 Umezu
4,869,073 A 9/1989 Kawai et al.
4,941,325 A 7/1990 Nuding
4,942,740 A 7/1990 Shaw et al.
4,974,665 A 12/1990 Zillner, Jr.
5,062,276 A 11/1991 Dudley
5,065,586 A 11/1991 Shapiro-Baruch
5,129,234 A 7/1992 Alford
5,265,433 A 11/1993 Beckwith
5,345,776 A 9/1994 Komazaki et al.
5,346,128 A 9/1994 Wacker
5,390,505 A 2/1995 Smith et al.
5,400,607 A 3/1995 Cayce
5,450,893 A 9/1995 Galba et al.
5,622,057 A 4/1997 Bussjager et al.
5,634,348 A 6/1997 Ikeda et al.
5,675,979 A 10/1997 Shah
5,752,389 A 5/1998 Harper
5,887,651 A 3/1999 Meyer
5,915,473 A 6/1999 Ganesh et al.
5,953,926 A * 9/1999 Dressler et al. ..... 62/175
5,984,002 A 11/1999 Kido et al.
5,992,160 A 11/1999 Tsuchiya et al.
6,012,296 A 1/2000 Shah
6,055,818 A 5/2000 Valle et al.
6,059,016 A 5/2000 Rafalovich et al.
6,079,483 A 6/2000 Morooka et al.
6,123,147 A 9/2000 Pittman
6,131,653 A 10/2000 Larsson
6,170,271 B1 1/2001 Sullivan
6,321,551 B1 * 11/2001 Backman et al. ..... 62/235
6,338,254 B1 * 1/2002 Alsenz ..... 62/79
6,355,091 B1 3/2002 Felber et al.
6,381,970 B1 5/2002 Eber et al.
6,427,454 B1 8/2002 West
6,427,461 B1 8/2002 Whinery et al.
6,491,094 B1 12/2002 Rayburn et al.
6,553,778 B1 4/2003 Tipton et al.
6,612,119 B1 9/2003 Eber et al.
6,644,049 B1 11/2003 Alford
6,705,093 B1 3/2004 Taras et al.
6,826,921 B1 12/2004 Uselton
2002/0023443 A1 * 2/2002 Eber et al. ..... 62/172
2002/0092318 A1 7/2002 Tipton et al.
2003/0029924 A1 2/2003 Kloster
2004/0089002 A1 5/2004 Rayburn

FOREIGN PATENT DOCUMENTS

JP 60-57142 4/1985
WO WO 82/03269 9/1982
WO WO 93/10411 5/1993
WO WO 00/75742 A1 12/2000
WO WO 02/50623 A1 6/2002
WO WO 03/054457 A1 7/2003

OTHER PUBLICATIONS

Rapid Engineering Publication, ICS II Sequence of Operation, Nov. 4, 1996.
Desert Aire Publication, Milwaukee, Wisconsin, Dehumidifier, Nov. 1998.
Desert Aire Publication, Milwaukee, Wisconsin, Technical Bulletin, Jun. 1998.
Modern Refrigeration and Air Conditioning p. 689, 1982.
Task/Ambient Conditioning Systems: Engineering and Application Guidelines, University of California, Oct. 1996.
SPORLAN, 3-Way Valves (Installation and Servicing Instructions), Sporlan Valve Company, Washington, MO Jun. 2001 / Bulletin 30-21.
SPORLAN, 3-Way Valves (The Right Solenoid Valve for any Job). Sporlan Valve Company, Washington, MO Jun. 2001 / Bulletin 30-20.
SPORLAN, Type 5D Three-Way Heat Reclaim Valve for Refrigerants 12-22-134a-502, Sporlan Valve Company, Washington, MO Dec. 1995 / Bulletin 30-10-1.
SPORLAN, Solenoid Valves, Sporlan Valve Company, Washington, MO Jan. 1993 / Bulletin 30-10.

* cited by examiner

SYSTEM AND METHOD FOR USING HOT GAS RE-HEAT FOR HUMIDITY CONTROL

CROSS-REFERENCE TO RELATED APPLICATIONS

This application claims the benefit of U.S. Provisional Application No. 60/424,929 filed Nov. 8, 2002.

BACKGROUND OF THE INVENTION

The present invention relates generally to a humidity control application for a cooling system. More specifically, the present invention relates to a method for performing humidity control using a hot gas reheat coil in a two stage cooling unit.

Some refrigeration systems use a hot gas re-heat control to perform humidity control for an interior space. A hot gas re-heat coil is placed immediately adjacent to an evaporator and receives air from the evaporator. When humidity control is required, the refrigerant from the compressor is passed through the re-heat coil instead of the condenser so that the re-heat coil can operate as a condenser to heat and further dehumidify the air passing over the re-heat coil. Once the system enters a humidity control mode, there is essentially no cooling of the air for the interior space because the air being cooled by the evaporator is then being heated by being passed over the re-heat coil. Some examples of previous systems for providing humidity control are provided below.

U.S. Pat. No. 6,553,778, hereafter the '778 Patent, describes a multi-stage cooling system having a plurality of independent refrigeration circuits to provide a plurality of cooling capacities. The refrigeration circuits have different capacity compressors, typically a larger capacity compressor and a smaller capacity compressor, which can be controlled and cycled by a controller to obtain different cooling capacities. The controller is also used for humidity control. The control system operates in a temperature control mode and enters a dehumidification mode only if the temperature control mode is unsuccessful at maintaining a desired humidity level. When dehumidification is required, the control system first attempts to control humidity by engaging the larger capacity compressor. If that is unsuccessful, then the larger capacity compressor is operated continuously with re-heaters to maintain a desired temperature and, if necessary, the lower capacity compressor can be cycled for temperature control. For a smaller load requirement in the system, the larger capacity compressor is cycled on in response to a call for cooling and/or dehumidification, a re-heater is cycled on in response to a call for dehumidification without a call for cooling, and a hot gas by-pass is engaged when there is a call for cooling without a call for dehumidification. One disadvantage of the '778 Patent is that a reheater (or heater circuit) separate from the refrigerant circuit is used to provide dehumidification.

U.S. Pat. No. 4,813,474, hereafter the '474 Patent, describes an air conditioner that provides dehumidification. The air conditioner includes a refrigerant circuit or cycle with a variable capacity compressor and a reheater arranged in association with the indoor heat exchanger. The variable capacity compressor and reheater are controlled based on a temperature differential to provide cooling and dehumidification. For a large temperature differential, e.g. >3° C., only the variable capacity compressor is operated under high capacity to provide cooling. As the temperature differential becomes smaller, both the compressor and reheater are operated at varying levels to provide the appropriate amounts of re-heat for a given temperature differential. One disadvantage of the '474 Patent is that a reheater (or heater circuit) separate from the refrigerant circuit is used to provide dehumidification.

U.S. Pat. No. 5,752,389, hereafter the '389 Patent, describes a cooling and dehumidification system that uses refrigeration re-heat for temperature control. The system has a standard refrigeration circuit with a re-heat coil connected in parallel with the outdoor coil and positioned adjacent to the indoor coil. A portion of the refrigerant is diverted from the outdoor coil to the re-heat coil to re-heat the air during the dehumidification mode, while the remaining refrigerant flows according to the regular refrigerant circuit. The amount of re-heat provided by the re-heat coil is determined in response to a sensor measurement in the discharge air and a set-point value. One disadvantage of the '389 Patent is that the amount of available humidity control is based on the discharge air temperature.

U.S. Pat. No. 5,345,776, hereafter the '776 Patent, describes a heat pump system that has two indoor heat exchangers connected by an expansion valve in a single refrigeration circuit. During heating and cooling modes, both indoor heat exchangers function as condensers and evaporators, respectively. During dehumidification mode operation, the first indoor heat exchanger cools and dehumidifies the air and the second indoor heat exchanger heats the cooled air before it is supplied to the room. One disadvantage of the '776 Patent is that humidity control cannot be provided during a cooling operation.

U.S. Pat. No. 5,129,234, hereafter the '234 Patent, describes a humidity control for regulating compressor speed. The humidity control is used with a heat pump system having a two-speed compressor. The humidity control is a slave to the temperature control of the heat pump system in that the humidity control is non-functional when the temperature demand has been satisfied. The humidity control can override the temperature control to provide enhanced dehumidification. The humidity control will typically override a command for low speed compressor operation with a high speed command when certain predetermined humidity criteria are not satisfied. One disadvantage of the '234 Patent is that humidity control cannot be provided without providing cooling to an interior space.

Therefore, what is needed is a system and method that can provide both humidity control and some cooling to the interior space in response to demands for both humidity control and cooling.

SUMMARY OF THE INVENTION

The present invention is directed to a humidity control method for a multi-stage cooling system having two or more refrigerant circuits that balances humidity control and cooling demand. Each refrigerant circuit includes a compressor, a condenser and an evaporator. A hot gas re-heat circuit having a hot gas re-heat coil is connected to one of the refrigerant circuits and is placed in fluid communication with the output airflow from the evaporator of that refrigerant circuit to provide additional dehumidification to the air when humidity control is requested. The hot gas re-heat circuit bypasses the condenser of the refrigerant circuit during humidity control. Humidity control is only performed during cooling operations and ventilation operations. During a first stage cooling operation using only one refrigerant circuit and having a low cooling demand, the request for humidity control activates the hot gas re-heat circuit for dehumidification and activates a second refrigerant circuit to provide cooling capacity. During a second stage cooling operation using two or more refrigerant circuits and having a high cooling demand, the request for humidity control is suspended and is initiated only upon the completion of the second stage cooling demand.

One embodiment of the present invention is directed to a method of providing humidity control to air for an interior space. The method includes the steps of providing a first refrigerant circuit having a first compressor, a first condenser and a first evaporator, providing a second refrigerant circuit having a second compressor, a second condenser and a second evaporator and providing a hot gas re-heat circuit connected to the first refrigerant circuit. The hot gas re-heat circuit has a re-heat coil positioned adjacent to the first evaporator and is configured, when enabled, to bypass the first condenser and to permit refrigerant to flow from the first compressor through the re-heat coil to the first evaporator. The method also includes the steps of enabling the first refrigerant circuit and the second refrigerant circuit in response to a demand for humidity control and a demand for cooling, wherein the demand for cooling is one of a demand for stage one cooling and a demand for stage two cooling, and enabling the hot gas re-heat circuit in response to a demand for humidity control and a demand for stage one cooling.

Another embodiment of the present invention is directed to a heating, ventilation and air conditioning (HVAC) system for an interior space. The HVAC system includes a first refrigerant circuit having a first compressor, a first condenser and a first evaporator, a second refrigerant circuit having a second compressor, a second condenser and a second evaporator, and a hot gas re-heat circuit connected to the first refrigerant circuit. The hot gas re-heat circuit has a re-heat coil positioned adjacent to the first evaporator and is configured, when enabled, to bypass the first condenser and to permit refrigerant to flow from the first compressor through the reheat coil to the first evaporator. The HVAC system also includes a control system to control operation of the first refrigerant circuit, the second refrigerant circuit and the hot gas re-heat circuit. The control system enables the first refrigerant circuit, the second refrigerant circuit and the hot gas re-heat circuit in response to demands for humidity control and stage one cooling. The control system also enables the first refrigerant circuit and the second refrigerant circuit and disables the hot gas re-heat circuit in response to demands for humidity control and stage two cooling.

One advantage of the present invention is that comfort cooling in the interior space is not completely sacrificed when there is a demand for humidity control.

Another advantage of the present invention is that the use of the re-heat coil for additional dehumidification provides greater energy efficiency.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
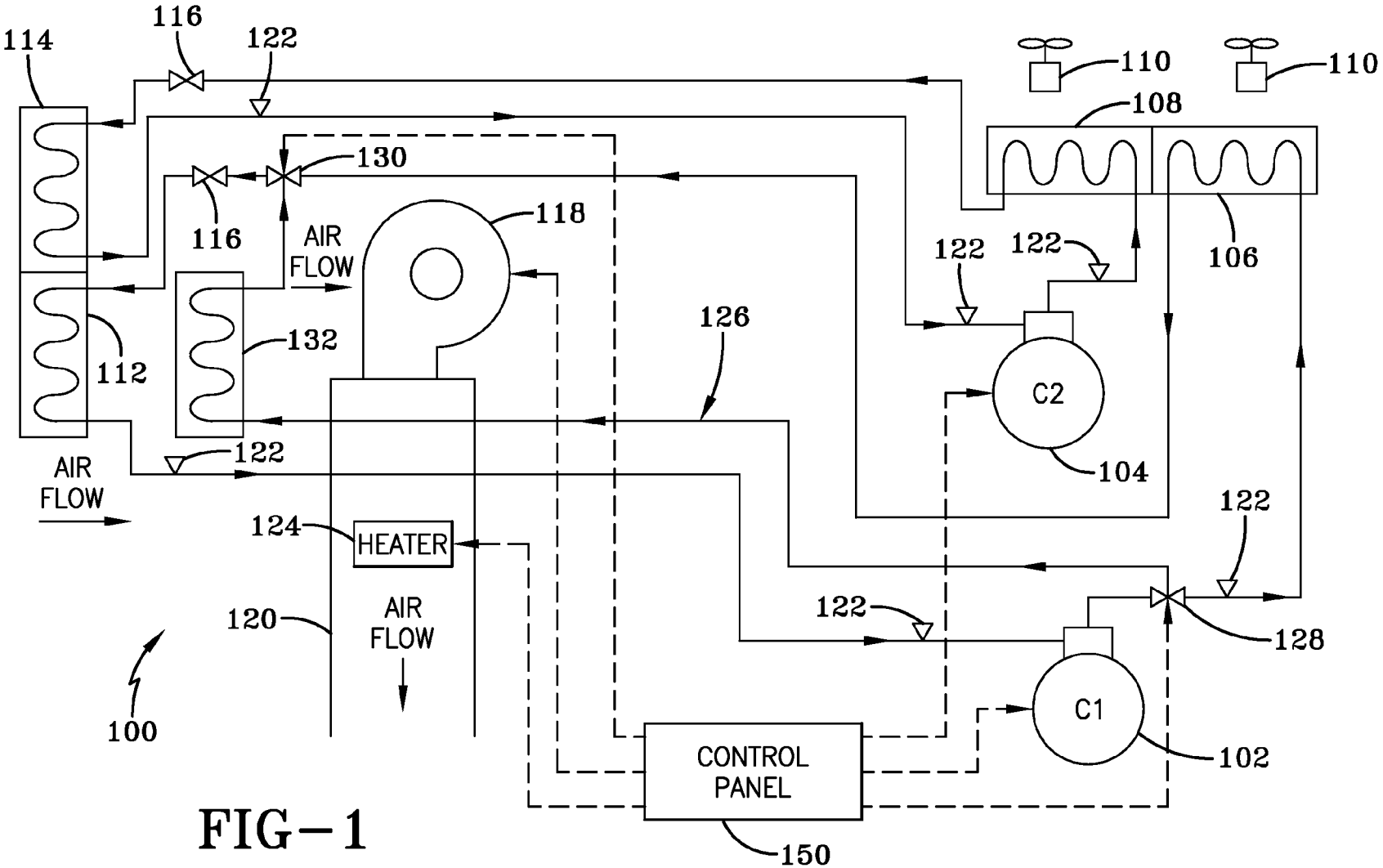
FIG. 1 illustrates schematically an embodiment of a heating, ventilation and air conditioning system for use with the present invention.

FIG. 1 illustrates one embodiment of a heating, ventilation and air conditioning (HVAC) system 100 for an interior space. The HVAC system 100 can also provide humidity control to the interior space. The HVAC system 100 is preferably a two stage cooling system using two compressors 102, 104 to provide two (or more) levels of cooling capacity in the interior space. The compressors 102, 104 can each be a screw compressor, a reciprocating compressor, a scroll compressor, a centrifugal compressor or any other suitable type of compressor. The two levels of cooling capacity can be obtained by operating either one of the compressors 102, 104 or both of the compressors 102, 104 depending on the cooling demand. The first level of cooling capacity is obtained by operating just one of the compressors 102, 104 during periods of lower cooling demand and the second level of cooling capacity is obtained by operating both of the compressors during periods of higher cooling demand. Furthermore, if one or both of the compressors 102, 104 is a variable capacity compressor, additional levels of cooling capacity for the HVAC system 100 can be obtained by operating the compressors 102, 104 at varying levels of compressor capacity.

The compressor used to provide the first level of cooling capacity can be referred to as the primary compressor or the stage one compressor and the compressor operated with the primary compressor to provide the second level of cooling capacity can be referred to as the secondary compressor or the stage two compressor. To simplify the explanation of the present invention and to correspond to the HVAC system 100 as shown in FIG. 1, compressor 102 will be referred to as the stage one or primary compressor and compressor 104 will be referred to as the stage two or secondary compressor. It is to be understood that in another embodiment of the present invention, compressor 104 can be used as the stage one or primary compressor and compressor 102 can be the stage two or secondary compressor.

The stage one compressor 102 is preferably operated during times when the cooling demand in the interior space is low. As the cooling demand in the interior space increases in response to a variety of factors such as the exterior temperature, the stage two or secondary compressor 104 is started. The operation of the two compressors 102 and 104 provides the maximum amount of cooling capacity from the HVAC system 100. A control program or algorithm executed by a microprocessor or control panel 150 is used to control operation of the HVAC system 100. The control program determines when the stage two compressor 104 is to be started in response to the higher cooling demand. The control program can receive a variety of possible inputs, such as temperature, pressure and/or flow measurements, in order to control operation of the HVAC system 100, e.g., for making the determination of when to start the stage two compressor 104. It is to be understood that the particular control program and control criteria for engaging and disengaging particular components of the HVAC system 100 can be selected and based on the particular performance requirements of the HVAC system 100 desired by a user of the HVAC system 100.

The compressors 102, 104 are each used with a separate refrigeration circuit. The compressors 102, 104 each compress a refrigerant vapor and deliver the compressed refrigerant vapor to a corresponding condenser 106, 108 by separate discharge lines. The condensers 106, 108 are separate and distinct from one another and can only receive refrigerant vapor from its corresponding compressor 102, 104. The condensers 106, 108 can be located in the same housing, can be positioned immediately adjacent to one another or alternatively, the condensers 106, 108 can be spaced a distance apart from one another. The positioning of the condensers 106, 108 can be varied so long as the separate refrigeration circuits are maintained. The refrigerant vapor delivered to the condensers 106, 108 enters into a heat exchange relationship with a fluid, preferably air, flowing over a heat-exchanger coil in the condenser 106, 108. To assist in the passage of the fluid over and around the heat exchanger coils of condensers 106, 108, fans 110 can be used to force air over the coils of the condensers 106, 108. The refrigerant vapor in the condensers 106, 108 undergoes a phase change to a refrigerant liquid as a result of the heat exchange relationship with the air flowing over the heat-exchanger coil. The condensed liquid refrigerant from condensers 106, 108 flows to a corresponding evaporator 112, 114 after passing through a corresponding expansion valve 116. Similar to the condensers 106, 108, the evaporators 112, 114 are separate and distinct from one another and can only receive refrigerant from its corresponding condenser 106, 108. The evaporators 112, 114 can be located in the same housing, can be positioned immediately adjacent to one another or alternatively, the evaporators 112, 114 can be spaced a distance apart from one another. The positioning of the evaporators 112, 114 can be varied so long as the separate refrigeration circuits are maintained.

The evaporators 112, 114 can each include a heat-exchanger coil having a plurality of tube bundles within the evaporator 112, 114. A fluid, preferably air, travels or passes over and around the heat-exchanger coil of the evaporators 112, 114. Once the air passes through the evaporators 112, 114, it is blown by blower 118 to the interior space via supply duct 120. The liquid refrigerant in the evaporators 112, 114 enters into a heat exchange relationship with the air passing through and over the evaporators 112, 114 to chill or lower the temperature of the air before it is provided to the interior space by the blower 118 and the supply duct 120. The refrigerant liquid in the evaporators 112, 114 undergoes a phase change to a refrigerant vapor as a result of the heat exchange relationship with the air passing through the evaporators 112, 114. In addition to cooling the air, the evaporators 112, 114 also operate to remove moisture from the air passing through the evaporators 112, 114. Moisture in the air condenses on the coils of the evaporators 112, 114 as a result of the heat exchange relationship entered into with the refrigerant in the heat-exchanger coil. The vapor refrigerant in the evaporators 112, 114 then returns to the corresponding compressor 102, 104 by separate suction lines to complete the cycle. The conventional HVAC system 100 includes many other features that are not shown in FIG. 1. These features have been purposely omitted to simplify the drawing for ease of illustration.

In addition, the HVAC system 100 can include one or more sensors 122 for detecting and measuring operating parameters of the HVAC system 100. The signals from the sensors 122 can be provided to a microprocessor or control panel 150 that controls the operation of the HVAC system 100 using the control programs discussed above. Sensors 122 can include pressure sensors, temperature sensors, flow sensors, or any other suitable type of sensor for evaluating the performance of the HVAC system 100.

The HVAC system 100 shown in FIG. 1 also has a heating mode and a ventilation mode. When the HVAC system 100 is required to provide heating or ventilation to the interior space, the compressors 102, 104 are shut down and the air passes through the evaporators 112, 114 to the blower 118 without any substantial change in temperature. The blower 118 then blows the air over a heater 124 located in the supply duct 120 or immediately adjacent to the supply duct 120 to heat the air to be provided to the interior space for the heating mode. The heater 124 can be an electrical heater providing resistance heat, a combustion heater or furnace burning an appropriate fuel for heat or any other suitable type of heater or heating system. In addition, the heater 124 can be configured to provide different levels of heating capacity depending on the heating demand. For the ventilation mode, the air, e.g. outside air, recirculated air or a mixture of outside air and recirculated air, passes through the evaporators 112, 114, which are inactivated, and then the blower 118 provides the air to the interior space through the supply duct 120 without any substantial change in temperature.

As mentioned above, the HVAC system 100 of FIG. 1 can provide humidity control to the interior space. In a preferred embodiment, the humidity control can be obtained through the use of a hot gas re-heat circuit 126 that is connected to the refrigeration circuit of the first stage compressor 102. The re-heat circuit 126 includes a first valve arrangement 128 positioned between the compressor 102 and the condenser 106, a second valve arrangement 130 positioned between the condenser 106 and the expansion valve 116, and a re-heat coil 132 in fluid communication with both the first valve arrangement 128 and the second valve arrangement 130. The first valve arrangement 128 and the second valve arrangement 130 are preferably three-way valves, but can be any suitable type of valve or valve configuration, e.g. a two-way valve or a check valve configuration, that selectively prevents the flow refrigerant in one direction, while selectively permitting refrigerant to flow in a second direction. The re-heat coil is also preferably in fluid communication with the air exiting evaporator 112 (and possibly, in another embodiment of the present invention, the air exiting evaporator 114) and the air entering the blower 118.

When HVAC system 100 is in a cooling mode, the first valve arrangement 128 is configured or positioned to permit refrigerant to flow from the compressor 102 to the condenser 106 and the second valve arrangement 130 is configured or positioned to permit refrigerant to flow from the condenser 106 to the expansion valve 116 and the evaporator 112. In contrast, when the HVAC system 100 is in a humidity control mode, the first valve arrangement 128 is configured or positioned to permit refrigerant to flow from the compressor 102 to the re-heat coil 132 and the second valve arrangement 130 is configured or positioned to permit refrigerant to flow from the re-heat coil 132 to the expansion valve 116 and the evaporator 112. The re-heat circuit 126 is used to bypass the condenser 106, when the HVAC system 100 is in the humidity control mode. The re-heat coil 132 then performs the heat exchange functions of the condenser 106 when the HVAC system 100 is in humidity control mode. The first and second valve arrangements 128, 130 can be any type of valve or valve configuration that can permit and prevent the flow of refrigerant as described in detail above, including an arrangement that uses check valves and "T" fittings in the refrigerant lines.

The humidity control operation of the HVAC system 100 is also controlled by the microprocessor or control panel 150. The control panel 150 receives input signals from a controller(s), such as a thermostat or humidistat, indicating a demand for cooling, heating, ventilation and/or humidity control. More specifically, the control panel 150 can receive input signals indicating a demand for stage one cooling, stage two cooling, humidity control, heating, and ventilation. In another embodiment of the present invention, the control panel 150 can receive inputs signals indicating a demand for stage one heating and/or stage two heating instead of a general signal indicating a heating demand. The control panel 150 also receives signals from sensors 122 indicating the performance of the HVAC system 100. The control panel 150 then processes these input signals using the control method of the present invention and generates the appropriate control signals to the components of the HVAC system 100 to obtain the desired control response to the received input signals.

Figure 2:
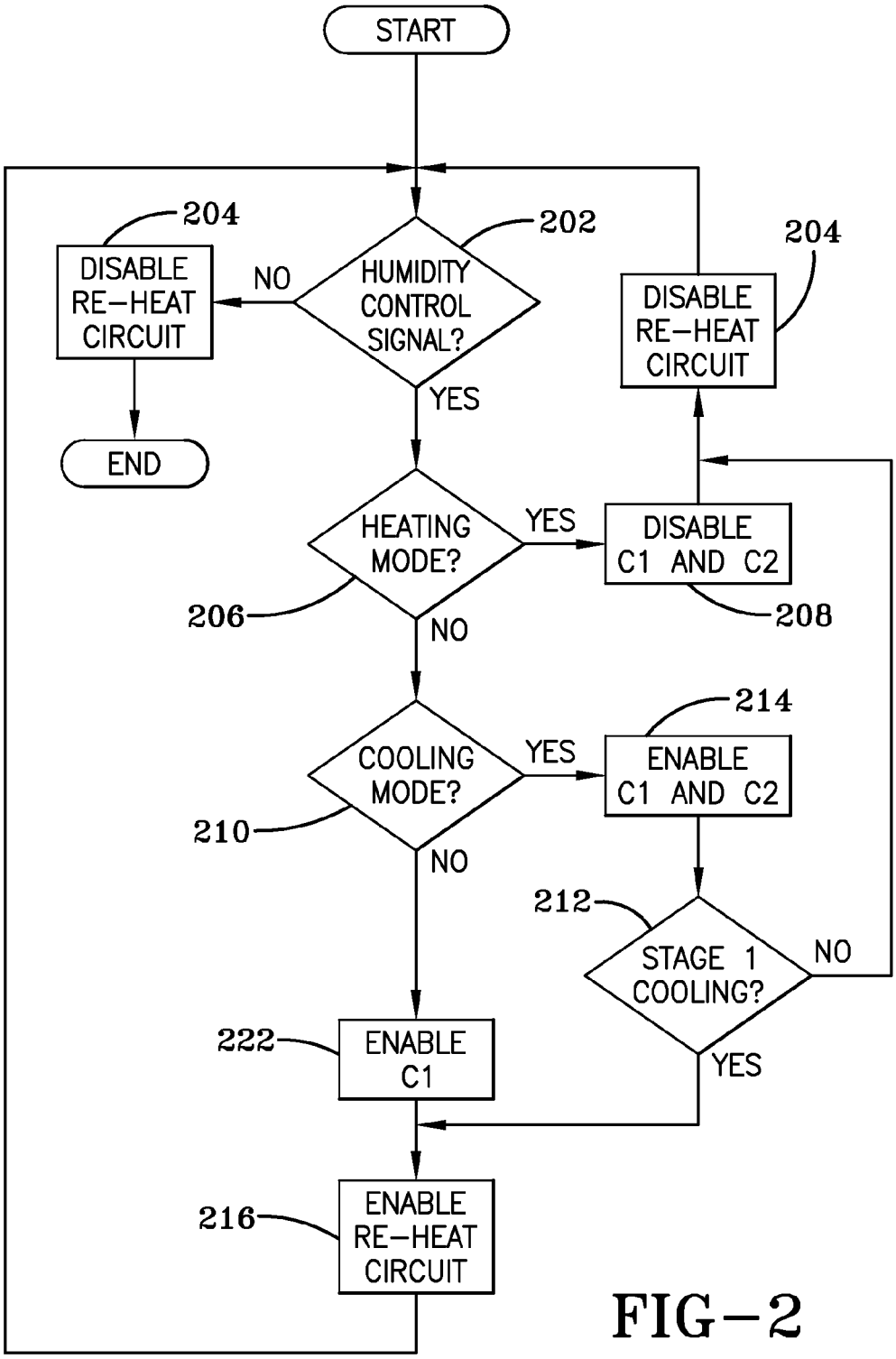
FIG. 2 illustrates a flow chart detailing the humidity control method of the present invention.

FIG. 2 illustrates a flow chart detailing the control process of the present invention relating to humidity control in a HVAC system 100 as shown in FIG. 1. The humidity control process of FIG. 2 can be implemented as a separate control program executed by a microprocessor or control panel 150 or the control process can be implemented as sub-program in the control program for the HVAC system 100. The process begins with a determination of whether the microprocessor or control panel has received a humidity control signal in step 202. The humidity control signal is generated by a controller such as a humidistat and indicates that humidity control is required in the interior space. If a humidity control signal is not received in step 202, the hot gas re-heat circuit 126 is disabled or closed in step 204 and the process is ended. The disabling of the hot gas reheat circuit involves positioning the valve arrangements 128 and 130 to prevent flow of refrigerant to the hot gas re-heat coil 132. It is to be understood that even if humidity control is not required, the HVAC system 100 can still provide heating, cooling, and ventilation using the control program for the HVAC system 100, as discussed above.

If a humidity control signal has been received, the process continues to step 206 to determine if the HVAC system 100 has received a heating mode signal. If the HVAC system 100 has received a heating mode signal in step 206, then primary and secondary compressors 102, 104 are disabled and/or shut down in step 208 and the hot gas re-heat circuit 126 is disabled as described above in step 204. The process then returns to step 202 to determine if a humidity control signal is present. When the HVAC system 100 is in the heating mode in response to receiving a heating mode signal, the compressors 102, 104 and the hot gas re-heat circuit 126 are disabled because the heating of the air by the heater 124 provides adequate dehumidification of the air provided to the interior space. If the HVAC system is not in the heating mode in step 206, the process advances to step 210 to determine if the HVAC system 100 has received a cooling mode signal.

If the HVAC system 100 has received a cooling mode signal in step 210, the compressors 102, 104 are enabled and/or started in step 214. Next, the control advances to step 212 to determine if the HVAC system 100 has received a stage one cooling mode signal. If the HVAC system 100 has received a stage one cooling mode signal, the hot gas re-heat circuit 126 is enabled in step 216 to provide additional humidity control to the air provided to the interior space. The hot gas re-heat circuit 126 is enabled by positioning the two-way valves 128, 130 to prevent the flow of refrigerant to the condenser 106 and to permit the flow of refrigerant through the re-heat coil 132 to further dehumidify the air from the evaporator 112. The starting of the secondary compressor 104 in step 214 enables evaporator 114 to provide cooling to a portion of the air provided to the interior space to satisfy the cooling demand. In this mode, the HVAC system 100 can provide both cooling and dehumidification to the air to satisfy both cooling demands and humidity control demands.

If the HVAC system 100 has not received a stage one cooling mode signal in step 212, then the HVAC system 100 is requiring stage two cooling mode operation and both primary and secondary compressors 102, 104 are to be operated to provide cooling to the interior space. The hot gas re-heat circuit 126 is disabled in step 204 after the determination in step 212 indicates the need for stage two cooling and the process proceeds to the beginning to check for a humidity control signal in step 202. Humidity control using the hot gas re-heat circuit 126 is not provided when the HVAC system 100 is providing stage two cooling. The operation of the evaporators 112, 114 to cool the air, provides some dehumidification of the air to the interior space. Once the demand for stage two cooling is lowered or reduced to only require stage one cooling, the hot gas re-heat circuit 126 can be enabled to provide dehumidification as discussed in greater detail above with regard to steps 212–216.

Referring back to step 210, if the HVAC system 100 has not received a cooling mode signal, then the HVAC system 100 requires only humidity control. To provide humidity control, the primary compressor is enabled and/or started in step 222 and the hot gas re-heat circuit 126 is enabled in step 216 to provide humidity control to the air for the interior space. In another embodiment of the present invention, the control process can engage the blower 118 in conjunction with one or more of the operational modes of the HVAC system 100, i.e., the humidity control mode, cooling modes and heating mode.

Humidity control using the hot gas re-heat circuit 126 and re-heat coil 132 can be provided when the HVAC system 100 receives a humidity control signal and receives a stage one cooling mode signal, a ventilation demand signal for the ventilation mode discussed in detail above or is not in operation. By not engaging the hot gas re-heat circuit 126 for humidity control except for the above mentioned modes, the humidity control method of the present invention can balance the need for cooling with the need for humidity control.

In another embodiment of the present invention, the user of HVAC system 100 can view the control panel 150 to determine the particular humidity control mode. For example, if an LED on the control panel is flashing two times, then the HVAC system 100 can be in humidity control mode without any demand for cooling. However, if the LED on the control panel is flashing three times, then the HVAC system 100 can be in a humidity control mode while there is a demand for comfort cooling. It is to be understood that the display method on the control panel 150 of the humidity control mode can be modified for the particular requirements or needs of the user.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of providing humidity control to air for an interior space, the method comprising the steps of:

providing a first refrigerant circuit having a first compressor, a first condenser and a first evaporator;

providing a second refrigerant circuit having a second compressor, a second condenser and a second evaporator;

providing a hot gas re-heat circuit connected to the first refrigerant circuit, the hot gas re-heat circuit having a re-heat coil positioned adjacent to the first evaporator, and the hot gas re-heat circuit being configured, when enabled, to bypass the first condenser and to permit refrigerant to flow from the first compressor through the re-heat coil to the first evaporator;

enabling the first refrigerant circuit and the second refrigerant circuit in response to a demand for humidity control and a demand for cooling, wherein the demand for cooling is one of a demand for stage one cooling and a demand for stage two cooling; and enabling the hot gas re-heat circuit in response to a demand for humidity control and a demand for stage one cooling.

2. The method of claim 1 further comprising the step of disabling the hot gas re-heat circuit in response to a demand for humidity control and a demand for stage two cooling.

3. The method of claim 1 further comprising the steps of:

enabling the first refrigerant circuit in response to a demand for only humidity control; and enabling the hot gas re-heat circuit in response to a demand for only humidity control.

4. The method of claim 1 further comprising the step of disabling the first refrigerant circuit, the second refrigerant circuit and the hot gas re-heat circuit in response to a demand for humidity control and a demand for heating.

5. The method of claim 1 further comprising the steps of:

providing a blower arrangement configured and disposed to receive air passing over the first evaporator, the second evaporator and the reheat coil and to provide the received air to a supply duct for distribution to an interior space; and enabling the blower arrangement in response to one of a demand for heating, a demand for stage one cooling, a demand for stage two cooling and a demand for humidity control.

6. The method of claim 1 wherein a demand for stage two cooling is greater than a demand for stage one cooling.

7. The method of claim 1 further comprising the step of receiving a humidity control signal, the humidity control signal being indicative of a demand for humidity control.

8. The method of claim 1 further comprising the step of receiving a cooling mode signal, the cooling mode signal being indicative of a demand for cooling.

9. The method of claim 8 wherein the step of receiving a cooling mode signal includes receiving a stage one cooling signal, the stage one cooling signal being indicative of a demand for stage one cooling.

10. A heating, ventilation and air conditioning (HVAC) system for an interior space, the HVAC system comprising:

a first refrigerant circuit having a first compressor, a first condenser and a first evaporator;

a second refrigerant circuit having a second compressor, a second condenser and a second evaporator;

a hot gas re-heat circuit connected to the first refrigerant circuit, the hot gas re-heat circuit having a re-heat coil positioned adjacent to the first evaporator, and the hot gas re-heat circuit being configured, when enabled, to bypass the first condenser and to permit refrigerant to flow from the first compressor through the reheat coil to the first evaporator; and a control system to control operation of the first refrigerant circuit, the second refrigerant circuit and the hot gas re-heat circuit, the control system enabling the first refrigerant circuit, the second refrigerant circuit and the hot gas re-heat circuit in response to demands for humidity control and stage one cooling, and the control system enabling the first refrigerant circuit and the second refrigerant circuit and disabling the hot gas re-heat circuit in response to demands for humidity control and stage two cooling.

11. The HVAC system of claim 10 wherein the control system enables the first refrigerant circuit and the hot gas re-heat circuit in response to a demand for only humidity control.

12. The HVAC system of claim 11 wherein the control system disables the first refrigerant circuit, the second refrigerant circuit and the hot gas re-heat circuit in response to demands for humidity control and heating.

13. The HVAC system of claim 10 further comprising a blower arrangement configured and disposed to receive air passing over the first evaporator, the second evaporator and the reheat coil and to provide the received air to a supply duct for distribution to an interior space.

14. The HVAC system of claim 13 wherein the control system enables the blower arrangement in response to one of a demand for heating, a demand for stage one cooling, a demand for stage two cooling and a demand for humidity control.

15. The HVAC system of claim 10 wherein a demand for stage two cooling is greater than a demand for stage one cooling.

16. The HVAC system of claim 10 wherein:

the hot gas re-heat circuit further comprises a first valve arrangement positioned in the first refrigerant circuit between the first compressor and first condenser and a second valve arrangement positioned in the first refrigerant circuit between the first condenser and the first evaporator; and the control system enables the hot gas re-heat circuit by positioning the first valve arrangement to permit refrigerant to flow from the first compressor into the re-heat coil and by positioning the second valve arrangement to permit refrigerant to flow from the re-heat coil to the first evaporator.

17. The HVAC system of claim 10 wherein the control system comprises a control panel and at least one sensor to measure an operating parameter of the first refrigerant circuit or the second refrigerant circuit.

* * * * *